United States Patent [19]

Casanova

[11] Patent Number: 4,602,827

[45] Date of Patent: Jul. 29, 1986

[54] ISLAND-TYPE CHEST FREEZER WITH HINGED COVER PANELS

[75] Inventor: Giuseppe Casanova, Trichiana, Italy

[73] Assignee: Costan S.p.A., Limana, Italy

[21] Appl. No.: 575,671

[22] Filed: Jan. 31, 1984

[30] Foreign Application Priority Data

Jan. 31, 1983 [IT] Italy ..... 20652/83[U]

[51] Int. Cl.[4] ..... A47F 3/04

[52] U.S. Cl. ..... 312/116; 62/246; 62/443; 312/214; 312/236

[58] Field of Search ..... 312/116, 214, 236, 296, 312/138 R, 328; 62/246, 443

[56] References Cited

U.S. PATENT DOCUMENTS

| | | | |
|---|---|---|---|
| 515,182 | 2/1894 | Warner | 312/116 X |
| 927,052 | 7/1909 | Joyce | 312/116 |
| 1,866,389 | 7/1932 | Bahls | 62/443 |
| 1,936,402 | 11/1933 | Mackenzie | 62/246 X |
| 2,025,997 | 12/1935 | McMillan | 62/246 X |
| 2,159,608 | 5/1939 | Ward, Jr. | 312/116 |
| 2,175,839 | 10/1939 | Hopkins | 62/246 |
| 2,442,882 | 6/1948 | Tull et al. | 62/443 X |
| 3,597,036 | 8/1971 | Buffington | 312/116 X |
| 3,729,243 | 4/1973 | Musgrave et al. | 312/116 |
| 3,759,059 | 9/1973 | Kenyon | 62/246 |

FOREIGN PATENT DOCUMENTS

| | | | |
|---|---|---|---|
| 582197 | 8/1959 | Canada | 312/116 |
| 671616 | 12/1929 | France | 62/246 |
| 899426 | 6/1962 | United Kingdom | 312/116 |

*Primary Examiner*—William E. Lyddane
*Assistant Examiner*—Thomas A. Rendos
*Attorney, Agent, or Firm*—Birch, Stewart, Kolasch & Birch

[57] ABSTRACT

An island-type chest freezer for the display of food products to the public. The chest includes a base and a rectangular container provided with an evaporator for receiving the products as well as cover panels. The chest freezer includes a beam disposed longitudinally in the container in a median position and at a level close to an upper edge of the cover panels. The beam acts as a support for the evaporator and for one side of the cover panel. The chest freezer allows the use of a single evaporator which, being centrally located, ensures uniform refrigeration within the container.

5 Claims, 1 Drawing Figure

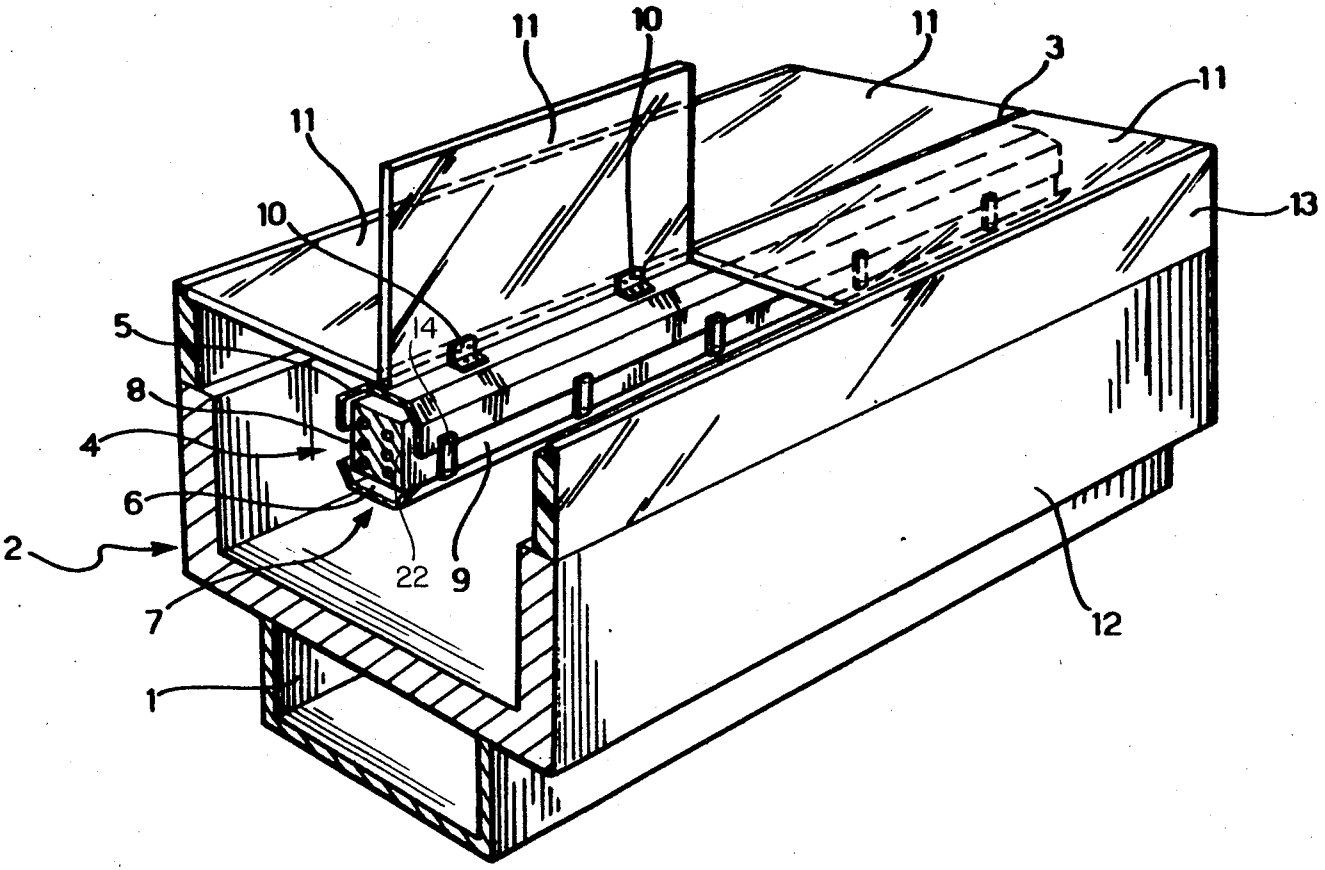
13
11
3
11
10
11
11
10
14
22
9
12
5
8
4
6
2
7
1

ISLAND-TYPE CHEST FREEZER WITH HINGED COVER PANELS

BACKGROUND OF THE INVENTION

1. Field of the Invention

The present invention relates to an island-type chest freezer for displaying food products to the public, including a base housing a condensor unit, a rectangular container having an evaporator for receiving the products and cover panels.

2. Description of Backgound Art

Freezers of the said type are generally formed by a base containing the condenser unit, supporting a chest in the form of a rectangular container; the walls of the container are thermally insulated and, close to the upper edge, along the two longer sides include two evaporators. The container is closable by means of removable insulating panels which are placed over the container only during the hours of closure to the public.

Island freezers according to the current art, with evaporators along the edges of the container, although widely used, have a few disadvantages. First the need to use two evaporators to provide unform refrigeration within the container. Second, the need to remove the covers completely at the beginning of the turn of duty (placing them elsewhere) and of putting them back at the end. Finally, the presence of the evaporators makes the edges of the container rather bulky, obstructing the customer in the selection and removal of products.

OBJECTS AND SUMMARY OF THE INVENTION

The object of the present invention is to overcome the above disadvantages. The present invention provides a beam located longitudinally in the container in a median position at a level close to that of the upper edge, the beam acts as a support for the evaporator and for one side of the cover panels.

The advantages of a freezer according to the invention and other characteristics thereof will become clearer from the following description of a preferred embodiment made with reference to the appended drawing.

BRIEF DESCRIPTION OF THE DRAWING

The FIGURE is a partial sectional perspective view of the freezer according to the present invention.

DETAILED DESCRIPTION OF THE PREFERRED EMBODIMENT

The freezer comprises a base 1 housing the condenser unit not shown in the drawing in that it is conventional. Above the base 1 is a thermally insulated rectangular container 2 for receiving the refrigerated products. The container 2 includes two shorter walls 3. Close to the upper edge of the two shorter walls 2 and in a median position are fixed the ends of a beam 4. The beam 4 is constituted by two profiled sections, an upper one and a lower one, connected by a plurality of plates 14. The upper profiled section 5 has a *substantially* U section facing downwardly while the lower profiled section 6 has a *substantially* flat section. The mutual positioning of the two profiled sections 5 and 6 forms a cavity 7 the lower side of which is closed by the profiled section 6, the upper side by the profiled section 5 and the upper parts only of the sides by the profiled section 5. The cavity 7 thus being in communication with the interior of the container 2 by means of two longitudinal side apertures 8 and 9. An evaporator coil 22 is operatively positioned wihtin the two profiled sections 5, 6 for cooling the interior of the container 2.

Two access cover panels 11 are fixed by hinges 10 to the upper part of the profiled section 5. The cover panels 11 may possibly be transparent and provided with stay members, not shown in the drawing, of conventional type for locking them in the open position.

The upper parts of the longer walls 12 of the container 2 are constituted by transparent panels 13.

A freezer according to the invention thus allows the use of a single evaporator which being symmetrically and centrally positioned, itself alone guarantees uniform refrigeration within the whole of the container.

The presence of a central beam also allows the hinging of the cover panels thereto, very much expediting the operations at the beginning and end of the period of use. Moreover, the panels being made of transparent material, it is possible to keep all the panels in the covering positions leaving the function of lifting them to the customer only at the moment at which he takes the goods therefrom.

Moreover, the fact that the longitudinal sides no longer house the evaporators allows them to have a more slender form. Possibly the upper part of the walls may be transparent in order to improve the visibility of the contents of the container, in other words increasing the exposed surface.

I claim:

1. An island-type chest freezer for displaying food products to the public comprising:

a substantially retangular container having two upstanding elongated walls affixed to two upstanding shorter walls, said substantially rectangular container including an upper edge extending around an upper peripheral surface thereof;

a tubular beam member extending longitudinally within said substantially rectangular container at approximately a median position with respect to said shorter walls and affixed adjacent to an upper edge of said two upstanding shorter walls;

said tubular beam member including an upper profiled section and a lower profiled section spaced relative to each other and forming a space therebetween which is in communication with the interior of said substantially rectangular container;

an evaporator coil positioned within said space in said tubular beam member and extending therealong for cooling the interior of said substantially rectangular container;

a cover panel extending across the upper edge of said substantially rectangular container and forming a closure therefor, said cover includes at least one portion hinged to said beam for providing access to said substantially rectangular container.

2. An island-type chest freezer according to claim 1, wherein said cover panel is constructed from transparent material to permit an individual to view the interior of said substantially rectangular container.

3. An island-type chest freezer according to claim 1, wherein said upper and lower profiled sections are connected together by a plurality of plates for spacing said upper and lower profiled sections relative to each other.

4. An island-type chest freezer according to claim 1, and further including a base member for supporting said substantially rectangular container.

5. An island-type chest freezer according to claim 1, wherein an upper portion of said two upstanding elongated walls are constructed of a transparent material to permit an individual to view the interior of said substantially rectangular container.

* * * * *